United States Patent [19]

Warmath

[11] Patent Number: 4,701,983

[45] Date of Patent: Oct. 27, 1987

[54] CLOTHES CLIP FOR A HANGER

[76] Inventor: John G. Warmath, 175 Steuben St., Brookyln, N.Y. 11205

[21] Appl. No.: 753,160

[22] Filed: Jul. 9, 1985

[51] Int. Cl.[4] ..... A47J 25/14

[52] U.S. Cl. ..... 24/511; 24/530; 24/564; 223/91

[58] Field of Search ..... 24/511, 564, 567, 562, 24/530, 536, 503, 504, 499, 498, 493, 489; 223/85, 91, 93

[56] References Cited

U.S. PATENT DOCUMENTS

| | | | |
|---|---|---|---|
| 2,471,606 | 5/1949 | Burns | 24/511 |
| 2,496,109 | 1/1950 | Terry | 24/530 |
| 2,525,985 | 10/1950 | Weymouth | 24/511 |
| 2,583,784 | 1/1952 | Maccaferri | 24/564 |
| 3,456,262 | 7/1969 | Coon | 24/511 |
| 3,950,829 | 4/1976 | Cohen | 24/503 |
| 4,335,838 | 6/1982 | Bisk et al. | 24/564 |

FOREIGN PATENT DOCUMENTS

| | | | |
|---|---|---|---|
| 143506 | 9/1950 | Australia | 24/511 |
| 405644 | 3/1969 | Australia | 24/567 |
| 803553 | 4/1951 | Fed. Rep. of Germany | 24/511 |
| 277009 | 11/1951 | Switzerland | 24/511 |
| 697,866 | 9/1953 | United Kingdom | 24/511 |

*Primary Examiner*—Victor N. Sakran

*Attorney, Agent, or Firm*—Louis E. Marn

[57] ABSTRACT

There is disclosed an improved clip assembly for positioning on a garment hanger and comprised of a pair of jaw members and a U-shaped resilient bias member wherein each jaw member is generally of a planar shape including a first end portion including fingertip receiving recesses, an intermediate portion formed with an elongated longitudinally disposed channel and with an inclined wall terminating at a locking recess disposed proximate an end portion of the elongated channel and a second end portion including inwardly extending projections and wherein the U-shaped resilient bias member includes leg members each terminating in a foot portion having an inwardly extending projection and wherein in an assembled configuration each inwardly extending projection of each foot portion of the leg members of the U-shaped resilient bias member is disposed in respective recesses in the intermediate portion of each jaw member whereby the jaw members are in substantial face-to-face relationship with minimum, if any, ability to be significantly longitudinally displaced from one another as a result of flat contact surfaces between the inclined walls of the jaw member and restrictive longitudinal movement effected by the length of the channel with respect to a base portion of the U-shaped resilient bias member.

3 Claims, 3 Drawing Figures

CLOTHES CLIP FOR A HANGER

BACKGROUND OF THE INVENTION (1) Field of the Invention

This invention relates to garment hangers, and more particularly to an improved molded clip assembly for positioning on a molded garment hanger and the like.

(2) Prior Art

Commercially available hangers formed of plastic materials have essentially replaced garment hangers fabricated out or wood, and are generally comprised of a plastic body portion and a metal hook. The hook may be pivotally secured to the body to enable the body to swivel with respect to the hook. Examples of hanger structures including a plastic body and a metal suspending hook are found in U.S. Pat. Nos. 3,406,883 (Crane), 3,282,481 (Maxwell), and 3,407,979 (Patch). All-plastic garment hangers are also commercially available and many have been disclosed in U.S. Pat. Nos. 3,067,917 (Reller et al.), 3,116,860 (Urich), 3,209,966 (Wach), 3,463,369 (Moskowitz), 3,570,729 (Zuckerman), 3,897,893 (Lemmenes), 3,963,154 (Schwartz et al.), 3,973,705 (Erthein), 4,040,546 (Liebscher), and 4,074,838 (Blasnik et al.). Among the aforementioned patents, the patents to Schwartz et al., Liebscher, and Blasnik et al. each disclose all-plastic hangers having swivel hooks.

Conventional garment hangers also frequently include pinch-type jaw clips arrnaged to be located at various positions along a cross-bar to hold trousers or skirts on the hanger. Examples of such hangers are found in U.S. Pat. Nos. 2,378,578 (Oskow), 2,496,531 (Gray), 2,546,717 (Beetlestone et al.), 2,617,568 (Pechtel), and 3,950,829 (Cohen). Such plastic hangers do achieve various design goals, however suffer from one or more drawbacks, such as complexity of construction, difficults of assembly, limited utility, limited durability and ruggedness.

In U.S. Pat. No. 4,335,838 to Bish, there is disclosed an all-plastic hanger comprised of a swivel hook and all-plastic clips. Each plastic clip is arranged for ready assembly and releasable securement to the cross-bar of the hanger or to any other rod-like element having a longitudinal axis, and is comprised of a pair of jaws formed of a first plastic material and resilient bias means formed of a second plastic material. The second material has a higher tensile strength than the first plastic material. Each of the jaws is a generally planar memeber comprising an enlarged first end portion defining a finger grasping opening, an intermediate portion, and a second end portion including a projection extending normally to the plane of the jaw member. The intermediate portion includes an arcuate recess for receipt of a portion of the periphery of the cross-bar or other rod-like element. The bias means is a generally U-shaped member having a pair of outwardly flared legs, each of which is arranged to engage a respective one of the jaws to hold the jaws on the cross-bar or rod-like element so that the clip can be readily slid therealong and pivoted thereabout.

Such plastic clips were difficult to mount on the hanger arm since the jaw members could move longitudinally (i.e. up and down) with respect to each other, and did not remain securely assembled, notwithstanding the presence of the resilient bias member subsequent to assembly and during bulk storage. Additionally, such clip configuration did not permit assembly on a hanger arm by automatic machinery particularly when considering the lack of integrity of the assembled components as a result of the interrelationship between the location of the locking recess on the jaw member with respect to the projections of the resilient bias means. Still further, such a clip required the use of intermediate devices, e.g. spacer bars in the form of dowls, rods, etc. when mounted on merchandising cards.

OBJECTS OF THE INVENTION

An object of the present invention is to provide an improved plastic clip assembly.

Another object of the present invention is to provide an improved plastic clip assembly of improved assembled integrity.

Still another object of the present invention is to provide an improved plastic clip assembly obviating the use of temporary spacer bars with merchandise display cards.

A further object of the present invention is to provide an improved plastic clip assembly permitting assembly by automated machinery.

SUMMARY OF THE INVENTION

The objects of the present invention are achieved by an improved clip assembly comprised of a pair of jaw members and a U-shaped resilient bias member wherein each jaw member is generally of a planar shape including a first end portion including fingertip receiving recesses, an intermediate portion formed with an elongated longitudinally disposed channel and with an inclined wall terminating at a locking recess disposed proximate an end portion of the elongated channel and a second end portion including inwardly extending projections and wherein the U-shaped resilient bias member includes leg members each terminating in a foot portion having an inwardly extending projection and wherein in an assembled configuration each inwardly extending projection of each foot portion of the leg members of the U-shaped resilient bias member is disposed in respective recesses in the intermediate portion of each jaw member whereby the jaw members are in substantial face-to-face relationship with minimum, if any, abiltiy to be significantly longitudinally displaced from one another as a result of flat contact surfaces between the inclined walls of the jaw member and restrictive longitudinal movement effected by the length of the channel with respect to a base portion of the U-shaped resilient bias member.

BRIEF DESCRIPTION OF THE DRAWINGS

These and other objects of the instant invention will be readily appreciated by reference to the following detailed description when taken in connection with the accompanying drawings wherein like numerals designate like parts throughout and wherein.

DETAILED DESCRIPTION OF THE INVENTION

Figure 1:
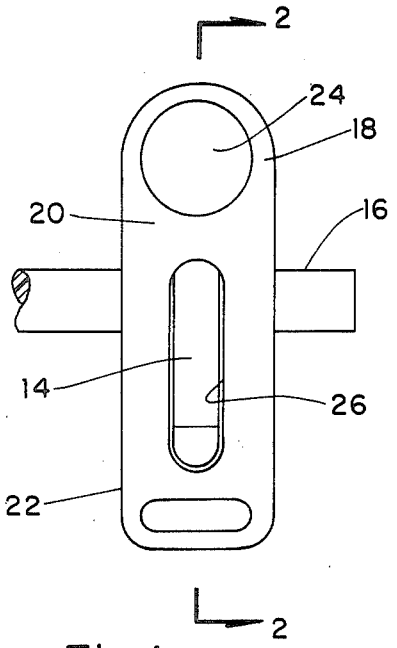
FIG. 1 is a plan view of the clip assembly of the present invention mounted on a hanger arm.
Figure 2:
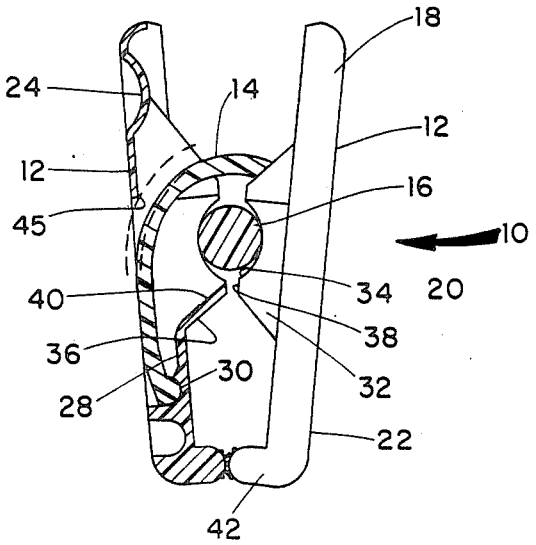
FIG. 2 is a side view of the clip assembly.
Figure 3:
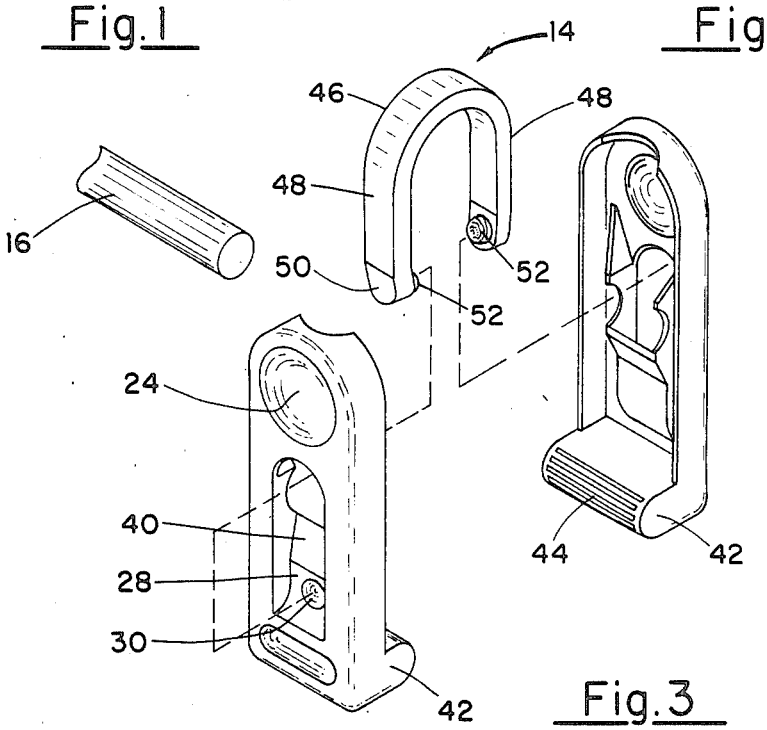
FIG. 3 is an isometric view of the clip assembly.

Referring now to the drawings, there is illustrated an improved clip assembly, generally indicated as 10, comprised of paired jaw members 12 and a U-shaped resilient bias member 14 for cooperatively positioning the paired jaw members 12. With particular reference to FIG. 2, there is illustrated a portion of a hanger cross-bar 16 on which is positioned the improved clip assembly 10 of the present invention, as more fully hereinafter described.

Each jaw member 12 is essentially planar in cross-section referring particularly to FIG. 2 and is comprised of a first end portion 18, an intermediate portion 20, and a second end portion 22. The first end portion 18 is formed with a circularly-shaped fingertip indentation recess 24 dimensioned to receive a user's finger therein and cooperates with the first end portion of a cooperating jaw member to permit a force to be exerted thereon as more fully hereinafter described.

The intermediate portion 20 is formed with an elongated channel 26 along a longitudinal axis of the jaw member 12. In a lower portion of the elongated channel 26, referring particularly to the cross-section side view portion of FIG. 2, there is formed a lower wall member 28 including a circularly-shaped locking recess 30 proximate a terminal end portion of the elongated channel 26. The width of the elongated channel 26 is slightly greater than the width of the U-shaped bias member 14 to provide lateral stability to the clip assembly 10 to substantially prevent lateral displacement of the jaw members 12 of the assembly clip assembly 10.

The intermediate portion 20 of each jaw member 12 is formed with an inwardly extending wedge portion 32 having an arcuate recess 34 configured to receive a hanger cross-bar 16 or member of like configuration. Within the elongated channel 26 as part of the wedge portion 32, there is formed a wall member 36 having a flat contact surface portion 38 and an outwardly disposed inclined surface 40 extending outwardly towards the wall member 28 including locking recess 30.

The second or lower end portion 22 is formed with an inwardly extending free end portion 42 having a plurality of ridges 44 formed thereon and extending the width of such free end portion 42.

The U-shaped resilient bias member 14 is generally rectangular in cross-section and is formed with an arcuate base portion 46 and leg member 48 terminating with inwardly extending foot portion 50. Each foot portion 50 is formed with an inwardly extending dimple or circularly-shaped projection 52 for positioning in the circularly-shaped locking recess 30 of cooperating jaw members 12 in the assembled configuration of the clip assembly 10. The U-shaped resilient bias member 14 is dimensioned to spring bias the jaw members 12 in the assembled clip assembly 10 wherein the distance between the projections 52 are slightly smaller than the distance between bottom portions of the locking recesses 28 prior to assembling the clip assembly 10. The arcuate base portion 46 of the U-shaped resilient bias member 14 is dimensioned to be in close proximity to an upper end portion of the channel 26 of each jaw member 12 whereby longitudinal movement between jaw member 12 is restrained by eventual contact at 45 between the arcuate base portion 46 of the bias member 14 with such upper end portion of the channel 26 of the intermediate portion 20 of each jaw member 12 (as shown by the dotted lines in FIG. 2) when the jaw members 12 are moved longitudinally with respect to one another.

The jaw members 12 are arranged to be disposed in face-to-face relationship about the hanger cross-bar 16 positioned within the arcuate recess 34 of the wedge-shaped portions 32 thereby forming a fulcrum therebetween and with the arcuate base portion 46 of the resilient U-shaped biased member 14 encirculating the hanger cross-bar 16 and the paired jaw members 12 to hold the clip assembly 10 about the hanger cross-bar 16. The second end portions 22 form a mouth for the clip assembly 10 which is readily opened to receive a garment by grasping the first end portions 18 and exerting an inward force towards each other against the tension force of the bias member 14, thereby displacing the free end portions 42 away from each other. Positioning of a garment between the free end portions 42 and thereafter removing the inward force permits the resilient bias member 14 to exert a force on the second end portions 22 to cause the second end portions to pivot about the hanger cross-bar 16 and thereby grasp the garment between the free end portions 42 of the second end portions 22 of the paired jaw members 12.

To assemble a clip assembly 10, paired jaw members 12 are arranged in face-to-face relationship with or without the aid of a hanger cross-bar 16 or like member. The U-shaped bias member 14 with the feet portions 50 extending downwardly is inserted downwardly into the channels 26 between the first or upper portions 14 of the jaw members 12 to a point where the dimples or circularly-shaped projections 52 thereof contact outwardly extending surfaces 40 of the wall member 36 of the intermediate portion 20. Continued downward movement of the U-shaped resilient bias member 14 permits the leg members 48 thereof to be guided within the channels 26 to a point where the dimples or inwardly extending projections 52 are seated within the recesses 30 thereby effecting assembly of the clip assembly 10. Since the locking recesses 30 are formed proximate a terminal end portion of the elongated channels 26 of the cooperating jaw members 12, the cooperating jaw members 12 are held in substantial face-to-face relationship with minimal, if any, capability of longitudinal movement notwithstanding the interlocking cooperation between the ridges 44 formed on the inwardly extending free end projections 42 of the second end portions 22 of the paired jaw members 12. An important aspect of the present invention is the ability of the clip assembly 10 to maintain assembled integrity, i.e. minimal longitudinal movement (let alone lateral movement) between paired jaw members 12 as a result of the interrelationship between the configuration of the arcuate base portion 46 of the bias member 14 with respect to the upper end portion of the channels 26 as hereinabove discussed.

The clip assembly 10 may be readily positioned on a hanger cross-bar 16 by initially positioning a hanger cross-bar 16 below the wedge portions 32 in a manner similar to positioning a garment between the free end projections 42, and thereafter exerting a downward force whereby the hanger cross-bar 16 rides along an interior surface of the wall member 36 until the hanger cross-bar 16 is caused to be positioned within the arcuate recesses 34 of the respective wedge portions 32 of the paired jaw members 12.

Removal of the clip assembly 10 from a hanger cross-bar 16, when desired, is readily effected by rotating the second end portions of the clip assembly about a plane perpendicular to the axis of the hanger cross-bar 16 while simultaneously exerting inward pressure on the first end portions 18 of the jaw members 12 and continuing such rotational motion until the clip assembly 10 is disengaged from the hanger cross-bar 16.

While the invention herein has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited to the claims and the equivalents thereof.

What is claimed:

1. A clip assembly arranged for ready assembly on a rod-like element of a predetermined diameter and having a longitudinal axis, said clip assembly comprised of a pair of cooperating jaw members and a resilient bias member, each of said jaw members being a generally planar member and comprised of an elongated first end portion having a fingertip recess, an intermediate portion, and a second end portion including a projection extending at an angle to the plane of said jaw member, said intermediate portion including a wedge portion defining an arcuate recess therein for close receipt of a portion of the periphery of said rod-like element when said clip is assembled thereon, said intermediate portion formed with an elongated channel and a locking recess disposed about a terminal end portion of said elongated channel proximate said second end portion of said jaw member, said resilient bias member being generally U-shaped and comprised of an arcuate base portion and inwardly extending leg members terminating in a free end having inwardly extending projections, said arcuate base portion of said U-shaped resilient bias member being dimensioned to contact and cooperate with an upper end portion of said elongated channels formed in said intermediate portion of said pair of cooperating jaw members to restrain longitudinal movement between said cooperating jaw members, said elongated channel of said intermediate portion of each of said jaw members being of a width slightly greater than a width of said leg member to accommodate the leg member disposed therein thereby to provide lateral stability of said clip assembly, said free ends of said bias member being spaced apart by a distance less than a distance between said locking recess of said cooperating jaw members to enable said bias member to be readily secured to said jaw members with said projections of each of said leg members of said bias member overlying and engaging a locking recess of a respective one of said jaw members and said arcuate recesses of said wedge portions of said cooperating jaws forming a substantially circularly-shaped opening to permit positioning of said rod-like member therein.

2. The clip assembly as defined in claim 1 wherein said intermediate portion of said jaw members includes a wall member having an inclined surface leading to said locking recess to permit each leg member of said bias member to slide along said surface and into said recess to facilitate assembly of said clip.

3. The clip assembly as defined in claim 2 wherein said wall member has an inwardly extending surface to permit a hanger cross-bar to be readily positioned within said arcuate recesses of said wedge portions of said cooperating jaw members.

* * * * *